United States Patent [19]

Suiter

[11] Patent Number: 4,795,152

[45] Date of Patent: Jan. 3, 1989

[54] BOWLING LANE WITH TRANSPARENT PLASTIC FILM FINISHING LAYER

[76] Inventor: James R. Suiter, 2030 N. 104th St., Omaha, Nebr. 68134

[21] Appl. No.: 940,428

[22] Filed: Dec. 11, 1986

Related U.S. Application Data

[63] Continuation-in-part of Ser. No. 871,318, Jun. 6, 1986.

[51] Int. Cl.[4] ..... A63D 1/04

[52] U.S. Cl. ..... 273/51; 156/71; 428/343

[58] Field of Search ..... 273/51; 156/71; 428/151, 343, 203, 204, 908.8

[56] References Cited

U.S. PATENT DOCUMENTS

| | | | |
|---|---|---|---|
| 2,898,825 | 8/1959 | Walker et al. | 94/1.5 |
| 3,097,986 | 7/1963 | Kauer | 156/497 |
| 3,617,424 | 11/1971 | Smith | 156/577 |
| 3,765,972 | 10/1973 | Wesp | 156/71 |
| 4,139,671 | 2/1979 | Kelly et al. | 273/51 X |
| 4,205,843 | 6/1980 | Murrey | 273/51 |
| 4,221,620 | 9/1980 | Milne | 156/71 |
| 4,221,628 | 9/1980 | Rosenberg et al. | 156/577 |
| 4,231,573 | 11/1980 | Kelly | 273/51 |
| 4,244,570 | 1/1981 | Murrey, Sr. | 273/51 |
| 4,307,883 | 12/1981 | Kelly | 273/51 |
| 4,337,290 | 6/1982 | Kelly et al. | 428/201 |
| 4,406,456 | 9/1983 | Berry et al. | 273/51 |
| 4,409,287 | 10/1983 | Harrison | 428/343 |
| 4,591,525 | 5/1986 | Cass | 273/1 R X |

*Primary Examiner*—Anton O. Oechsle

*Attorney, Agent, or Firm*—Kenyon & Kenyon

[57] ABSTRACT

A film of material is extended over a bowling lane surface in a dry state and adhered thereto. The film is preferably an adhesive backed plastic film which may be either transparent or opaque, as preferred. The plastic film is preferably provided in a strip of such a width so that no trimming is necessary after the material is applied.

5 Claims, 1 Drawing Sheet

BOWLING LANE WITH TRANSPARENT PLASTIC FILM FINISHING LAYER

CROSS-REFERENCE TO RELATED APPLICATION

This is a continuation-in-part of patent application Ser. No. 871,318 filed on June 6, 1986.

BACKGROUND OF THE INVENTION

The present invention is directed generally to an apparatus for quickly and easily refinishing a smooth flat surface subject to wear and more particularly to an apparatus for refinshing a bowling lane by applying lane finish in a solid state, as compared to a liquid state as is now done.

Effective maintenance of modern bowling lanes conventionally entails resanding of the wood lane surface every other year together with applying a liquid finish coat onto the resanded surface. In the off years between sandings, additional liquid finish might be applied to the lanes where needed.

This periodic refinishing generally represents a substantial expense for the bowling lane operator. Because special equipment and materials are required and uniformity in the thickness of the applied top coating is very important, such refinishing is generally beyond the capability of regular bowling lane attendants and maintenance personnel. Independent professionals are generally employed for this service.

In addition to the expense, the conventional sanding and refinishing operations are time consuming and generally require the lanes being worked on to be taken out of service for at least a few days.

Another disadvantage of conventional bowling lane refinishing is the practical impossibility of applying a perfectly uniform finish coat even if done by a professional. Finally, the periodic resanding will eventually cause the lane surface to be worn down to the point where the nails securing the lane bed boards together become exposed, at which point the lane is generally rendered inoperative so as to require replacement.

Accordingly, a primary object of the invention is to provide an improved material for refinishing a flat surface subject to wear.

Another object of the invention is to provide an improved bowling lane refinishing material.

Another object is to provide a replacement finish comprised of a transparent plastic film applied with uniform thickness onto a bowling lane.

Another object is to provide an antislide film to the pin deck to prevent pins from sliding and to protect the pin deck.

Another object is to provide a finish film to the pin deck approach for a uniform sliding effect.

Finally, another object of the invention is to provide a bowling lane refinishing material which is inexpensive and efficient and which affords a rugged uniform top surface.

SUMMARY OF THE INVENTION

Resurfacing or refinishing a bowling lane is substantially simplified according to the present invention wherein a film layer of material is applied onto the bowling lane surface and securely adhered thereto. The film is preferably an adhesive backed material so that no separate step of applying the adhesive is required. Likewise, the film is preferably provided in a width corresponding to the width of the bowling lane so that a single strip of the material covers the lane and no trimming of the lateral edges is required except on narrow lanes under 42 inches wide.

The applied layer of material may either be transparent to expose the natural beauty of the wood surface or be opaque with a printed pattern to cover old worn surfaces.

DESCRIPTION OF THE PREFERRED EMBODIMENT

Figure 1:
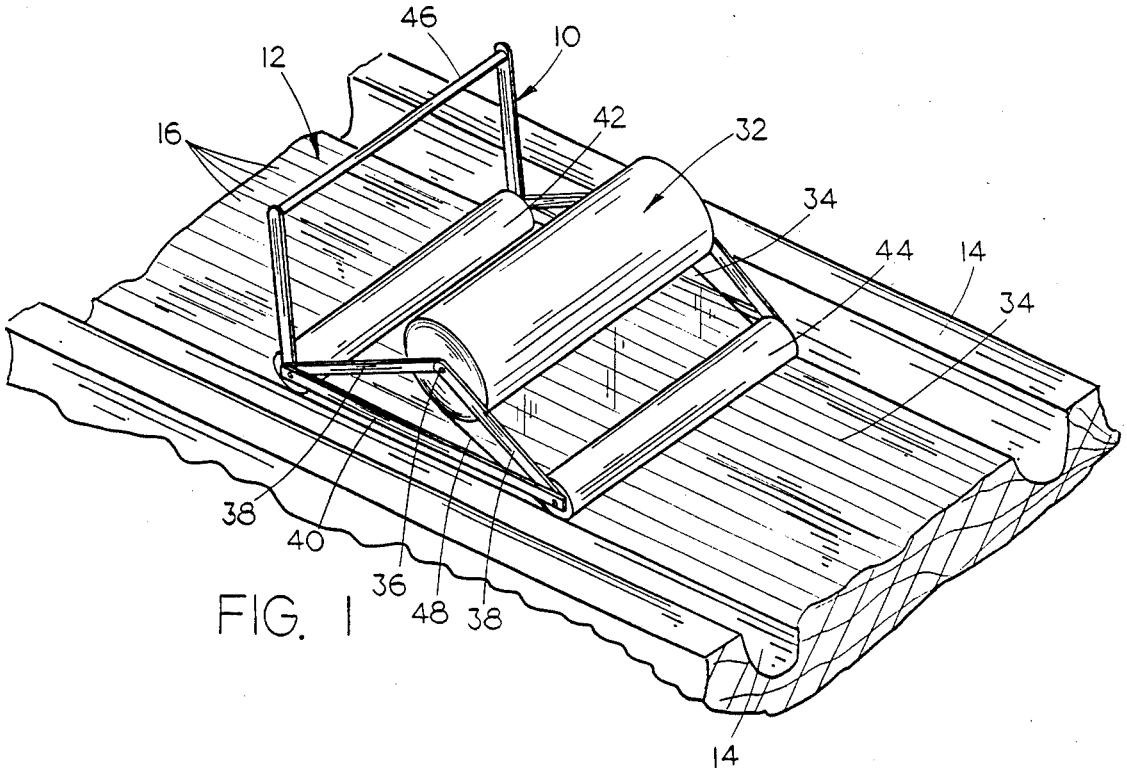
FIG. 1 is a foreshortened partial perspective view of a bowling lane with a roll of an adhesive backed topcoat material being supported on an applicator apparatus and being applied to the lane surface.

FIG. 1 illustrates a tape applicator apparatus 10 supported on a conventional wood bowling lane 12 that is situated between a pair of parallel spaced apart gutters 14. The conventional bowling lane is 42" wide and has a top surface formed by a plurality of interconnected wood leveling strips 16. Each board has an oppositely facing tongue 18 and a groove 20 for a precise nested fit with adjacent boards. Nails 22 secure the lane boards together.

Figure 2:
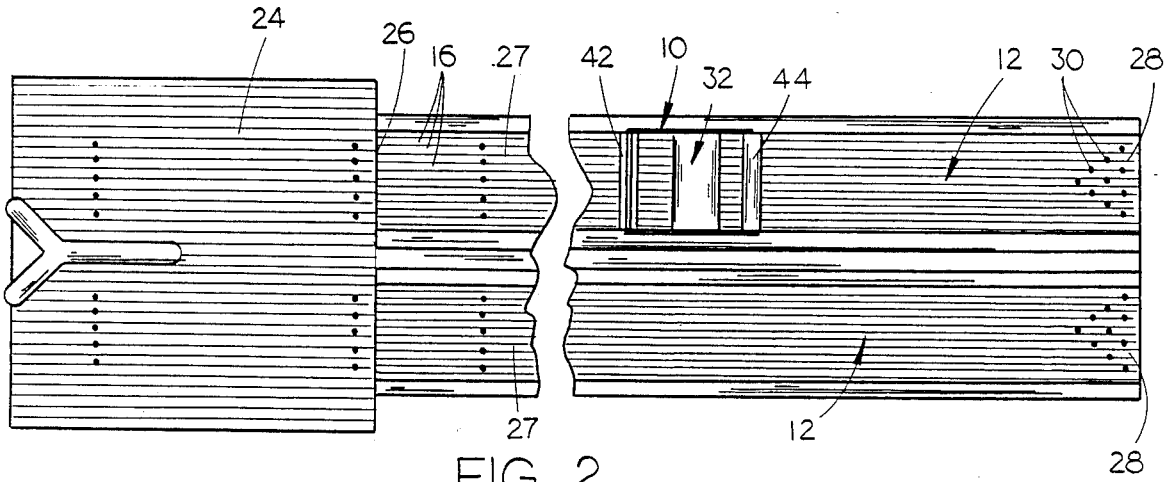
FIG. 2 is a foreshortened top plan view of a pair of bowling lanes including the refinishing tape applicator apparatus on one lane thereof.

Referring to FIG. 2, the conventional bowling lane furthermore includes an elongated approach area 24 that terminates at the foul line 26 which marks the one end of the lane. The first 16 feet of lane extending from the foul line is referred to as the "headers" and includes the lane markings designating various transverse positions on the lane. At the opposite end of the lane, pins are adapted to be set up on what is referred to as the "pin deck" in a pattern as indicated by the markings 30. Whereas the headers 27 are generally formed of a hard maple wood, the remainder of the lane may be formed of a softer pine with the exception of the pin deck which is commonly made of maple.

The present invention is directed to a novel coating for the bowling lane, which coating is provided as a roll 32 of flexible material or, more precisely, a plastic film. "Flexible" is here used to describe the bendability of the tape but is not intended to imply any degree of stretchability. It is preferred that the material be as stretch resistant as possible and that it be resistant to both impact and wear.

The plastic film 34 is preferably provided as a roll of adhesive backed transparent film. The film may be supported on apparatus 10 on a cross shaft 36 carried by a pair of support arms 38 which converge upwardly from a frame side member 40 which extends between front and rear rollers 42 and 44. A raised handle structure 46 facilitates movement of the apparatus 10 along the bowling lane 12.

In operation, a roll 32 of the transparent coating material is rotatably supported on apparatus 10 and the apparatus is positioned adjacent to one end of the bowling lane 12. The film is pulled downwardly transversely aligned with the lane 12 and pressed against the lane. Thereafter, it is only necessary to advance the apparatus 12 along the length of the lane whereby the transparent film or flexible material 34 is unrolled with the adhesive side 48 facing downwardly so that it can be pressed against the lane's surface by a rear roller 44.

Whereas the film applicator apparatus 10 is believed to greatly facilitate the application of the plastic film 34 onto the lane 12, it is contemplated that the plastic film could simply be manually unrolled onto the lane's surface without any apparatus. Alternatively, the plastic film 34 could be provided in flat sheets with a removable backing sheet to cover the adhesive side. The film may be applied on a freshly sanded wooden lane or onto the existing finish on such a lane or onto a synthetic lane.

The film is preferably of a width to exactly conform to the width of the bowling lane so that it covers the entire lane without any need for trimming any excess. The film may be applied along the full extent of the lane in a single strip or headers may be covered with a different type of film than that which is extended from the headers to the pin deck. For example, it may be desirable to provide the headers with film having means for facilitating sliding movement of a bowling ball on the flexible layer 34. This can be accomplished either by a very light oil finish or by forming the film of a material impreganted with silicone or the like. Likewise, a separate film may be applied to the pin deck for the antislide feature.

Figure 3:
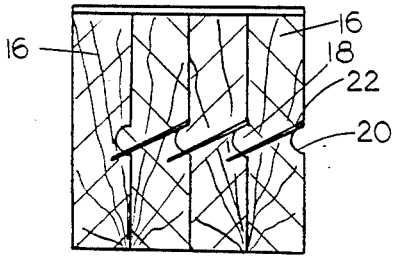
FIG. 3 is an enlarged cross-sectional view of a portion of a bowling lane, including a relatively thick coat applied to the top surface thereof.
Figure 4:
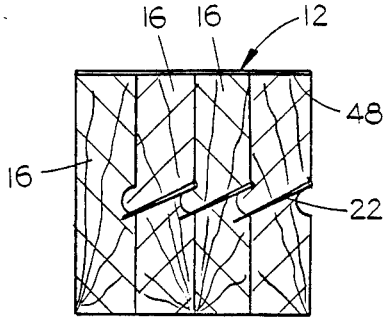
FIG. 4 is an enlarged sectional view of a bowling lane showing a relatively thin coat applied to the top surface thereof.

Furthermore, the film 34 may be applied as a relatively thin top coat, as shown in FIG. 4, having a thickness on the order of 3–10 mils or as a substantially thicker protective coat having a thickness on the order of 10–20 mils, preferably for the pin deck, as illustrated in FIG. 3. Whereas, a transparent tape is desirable for exposing the natural beauty of the wood lane, it may be desirable to cover a damaged or repaired lane surface with a film 34, which is opaque and exhibits a photographic top service resembling a natural wood pattern and possibly including all of the conventional bowling lane markings.

Suitable materials for the film include plastic such as polyurethane, polyethylene, vinyl, polyester and TEFLON materials and such nonplastics as fiberglass and other materials.

Whereas the adhesive backed film is preferred for ease of application, it is contemplated that the adhesive could be independently applied to the film or to the lane's surface prior to applying a plain film thereto. An adhesive dispenser and roller applicator could be mounted on the apparatus 10 for uniformly applying the adhesive to the underside of the film or directly to the lane in response to advancing movements of the apparatus.

When it is desired to replace the top coat film 34, the previous coat can preferably be stripped from the lane easily by simply raising a corner, then one end and then pulling the entire strip off the lane.

It will be appreciated that the apparatus disclosed herein will find application on other surfaces than bowling lanes. The tapelike top coat of the invention would be a natural for finishing a shuffleboard surface. This type of surface treatment would also be ideal for high traffic areas such as in airports and commercial building hallways.

The tapelike top coat of the invention currently simplifies the maintenance of surfaces subject to wear and assures a finished top coat of a uniform thickness and material characteristics. Thus, there has been shown and described a bowling lane refinishing apparatus which accomplishes at least all of the stated objects.

I claim:

1. In a complete bowling lane formed by a plurality of interconnected wood lane boards and having a substantially flat wood top surface, said lane including an approach, header section, pine section and pin deck, and an improved material for finishing the wood top surface of the bowling lane, the improvement comprising:

a uniform flexible film of transparent plastic material having a thickness of approximately 3 to 20 mils and covering the wood top surface of the bowling lane for at least a substantial portion of the length of the bowling lane, and a continuous layer of adhesive material disposed between said lane and flexible film, the adhesive material securely adhering said flexible film onto the wood top surface of the lane.

2. The improvement of claim 1 wherein said flexible film has top and bottom surfaces and wherein said adhesive material is preapplied to the bottom surface of said flexible film which is, therefore, provided as an adhesive-backed material.

3. The improvement of claim 2 wherein said flexible film is made of an impact resistant and wear resistant material.

4. The improvement of claim 2 wherein at least an initial length of said flexible film includes means for facilitating sliding movement of a bowling ball on said flexible film.

5. The improvement of claim 4 wherein said means for facilitating sliding movement comprises a lubricant material impregnated into said flexible film.

* * * * *